US007707865B2

(12) United States Patent
Sasaki

(10) Patent No.: US 7,707,865 B2
(45) Date of Patent: May 4, 2010

(54) FLAW DETECTION APPARATUS AND METHOD FOR TUBES

(75) Inventor: Kenichi Sasaki, Wakayama (JP)

(73) Assignee: Sumitomo Metal Industries, Ltd., Osaka (JP)

( * ) Notice: Subject to any disclaimer, the term of this patent is extended or adjusted under 35 U.S.C. 154(b) by 0 days.

(21) Appl. No.: 12/068,044

(22) Filed: Feb. 1, 2008

(65) Prior Publication Data

US 2008/0216537 A1 Sep. 11, 2008

Related U.S. Application Data

(63) Continuation of application No. PCT/JP2006/315216, filed on Aug. 1, 2006.

(30) Foreign Application Priority Data

Aug. 2, 2005 (JP) ..... 2005-224608

(51) Int. Cl.
*B21B 37/00* (2006.01)

(52) U.S. Cl. ..... 72/9.2; 72/9.5; 72/10.4; 72/12.7; 72/31.07

(58) Field of Classification Search ..... 72/9.2, 72/9.4, 10.3, 10.4, 11.8, 12.1, 31.07, 208, 72/209, 235, 9.5, 12.7, 12.8; 73/622, 637, 73/638

See application file for complete search history.

(56) References Cited

U.S. PATENT DOCUMENTS 4,491,731 A * 1/1985 Funyu et al. ..... 250/358.1
4,679,437 A * 7/1987 Koike et al. ..... 73/622
4,725,963 A * 2/1988 Taylor et al. ..... 702/40
5,379,237 A * 1/1995 Morgan et al. ..... 703/2
6,813,950 B2 * 11/2004 Glascock et al. ..... 73/633
6,954,991 B2 * 10/2005 Akatsuka et al. ..... 33/550
7,028,518 B2 * 4/2006 Sasaki et al. ..... 72/9.2

(Continued)

FOREIGN PATENT DOCUMENTS

JP 58-172507 10/1983

(Continued)

*Primary Examiner*—Edward Tolan
(74) *Attorney, Agent, or Firm*—Clark & Brody

(57) ABSTRACT

A flaw detection apparatus and flaw detection method for automatically detecting the occurrence of a flaw in a mother tube manufactured by rolling a hollow shell using a mandrel mill are provided. A flaw detection apparatus (100) according to the present invention includes a wall thickness gauge (1) which is installed on the exit side of a mandrel mill (M) and which measures the tube wall thickness in each of the reducing directions of a hollow shell (P) in the #1-#5 stands of the mandrel mill, rolling load measuring devices (2) which measure the rolling load in the #1-#5 stands, and a decision unit (3) which determines whether there are flaws in the mother tube based on the measured value of the tube wall thickness in each of the reducing directions of the hollow shell (P) and the measured value of the rolling load in each stand. The decision unit (3) determines that a flaw has occurred in the mother tube when the measured value of the tube wall thickness in any of the reducing direction in the #1-#5 stands locally varies by at least a predetermined amount and the measured value of the rolling load in any of the #1-#5 stands locally varies by at least a predetermined amount.

11 Claims, 4 Drawing Sheets

U.S. PATENT DOCUMENTS

| | | | | |
|---|---|---|---|---|
| 7,093,469 | B2 * | 8/2006 | Yamane | 72/9.2 |
| 7,174,761 | B2 * | 2/2007 | Iwamoto et al. | 72/235 |

FOREIGN PATENT DOCUMENTS

| | | | |
|---|---|---|---|
| JP | 59-1015 | * | 1/1984 |
| JP | 2-98664 | * | 4/1990 |
| JP | 04-084624 | | 3/1992 |
| JP | 07-246414 | | 9/1995 |
| JP | 08-071616 | | 3/1996 |
| JP | 10-328722 | * | 12/1998 |
| JP | 2001-293503 | | 10/2001 |
| JP | 2002-035817 | | 2/2002 |
| JP | 2003-220403 | | 8/2003 |
| JP | 2004-337941 | | 12/2004 |
| JP | 2005-131706 | * | 5/2005 |
| JP | 2005-193247 | * | 7/2005 |

* cited by examiner

FLAW DETECTION APPARATUS AND METHOD FOR TUBES

This application is a continuation of International Patent Application No. PCT/JP2006/1315216, filed Aug. 1, 2006. This PCT application was not in English as published under PCT Article 21(2).

TECHNICAL FIELD

This invention relates to a flaw detection apparatus and flaw detection method for tubes. Specifically, the present invention relates to a flaw detection apparatus and flaw detection method for tubes for automatically detecting flaws which develop in mother tubes manufactured by performing rolling of hollow shells using a mandrel mill.

BACKGROUND ART

FIGS. 5(*a*)-5(*d*) are explanatory views showing various types of flaws which develop in a mother tube manufactured by rolling a hollow shell using a mandrel mill.

FIG. 5(*a*) shows inner surface indentation flaws which are indentations 4 in the inner surface of a mother tube P. FIG. 5(*b*) shows perforation flaws which are holes 5 occurring when inner surface indentation flaws advance and reach the outer surface of a mother tube P. FIG. 5(*c*) and FIG. 5(*d*), which is a cross section in the circumferential direction of the mother tube P of FIG. 5(*c*), show a wrinkle flaw which is a portion 6 where the outer surface of a mother tube P is folded inwards. Each of these flaws is a major cause of occurrence of defective mother tubes.

In a mandrel mill, the presence of the above-described various flaws has conventionally been detected by direct visual observation of a rolled mother tube by an operator working in a control room located in the vicinity of the mandrel mill.

However, in recent years, as automation of tube forming facilities progresses, a control room is situated in a location remote from a mandrel mill. Therefore, situations have developed in which an operator cannot directly visually observe various types of flaws in a mother tube after rolling. Accordingly, even if various types of flaws develop in mother tubes which have undergone rolling using a mandrel mill, they cannot be rapidly detected, and there is a possibility of a larger number of defective products developing than in the past.

For example, Patent Documents 1-6 disclose inventions in which in order to suppress variations in wall thickness of the end portions of a mother tube which is rolled using a mandrel mill and in thickness deviations in the circumferential direction of the mother tube, the wall thickness of a mother tube rolled in the mandrel mill is measured by a wall thickness gauge positioned on the exit side of the mandrel mill, and based on the results of measurement, the rolling conditions of the mandrel mill are suitably changed.

Patent Document 1: JP H7-246414 A1
Patent Document 2: JP H8-71616 A1
Patent Document 3: JP 2001-293503 A1
Patent Document 4: JP 2002-35817 A1
Patent Document 5: JP 2003-220403 A1
Patent Document 6: JP 2004-337941 A1

DISCLOSURE OF INVENTION

However, a wall thickness gauge positioned on the exit side of a mandrel mill as disclosed in Patent Documents 1-6 is used solely for measuring the wall thickness of a mother tube in order to detect variations in the wall thickness at the ends of a mother tube or thickness deviations in the circumferential direction of the mother tube, and it can not detect various flaws which are shape defects appearing locally in a mother tube rolled with a mandrel mill. Therefore, as a matter of course, the inventions disclosed in these patent documents do not make it possible to automatically detect flaws which are found in a mother tube rolled using a mandrel mill.

The present inventors disposed a wall thickness gauge on the exit side of a mandrel mill in order to measure the wall thickness of a mother tube in the reducing directions (the directions of reduction by rolling) in each stand of the mandrel mill and checked the variations in the measured value of the wall thickness in the longitudinal direction of the mother tube. As a result, they found the following.

(a) When an inner surface indentation flaw or a perforation flaw develops in a mother tube, the measured value of the wall thickness in a portion corresponding to the portion where an inner surface indentation flaw or a perforation flaw is present locally decreases, and when a wrinkle flaw develops in a mother tube, the measured value of the wall thickness in a portion corresponding to the portion where the wrinkle flaw is present locally increases.

(b) When an inner surface indentation flaw, a perforation flaw, or a wrinkle flaw develops in a mother tube, the measured value of the rolling load in one stand locally varies.

Accordingly, by monitoring local variations in the measured value of the wall thickness in the longitudinal direction of a mother tube during rolling with a wall thickness gauge and monitoring local variations in the measured value of the rolling load, when both of these measured values exceeds their respective predetermined threshold values, it is decided that an inner surface indentation flaw, a perforation flaw, or a wrinkle flaw occurred, thereby making it possible to automatically detect with high accuracy the occurrence of a flaw in a mother tube which is rolled using a mandrel mill.

The present invention is an apparatus of detecting a flaw in a mother tube characterized by comprising a wall thickness gauge disposed on the exit side of a mandrel mill for measuring the tube wall thickness in each of the reducing directions of a hollow shell being rolled in a plurality of stands constituting the mandrel mill, rolling load measuring devices for measuring the rolling load in each of the plurality of stands, and a decision unit which determines, based on the measured value of the tube wall thickness in each of the reducing directions of a hollow shell in the plurality of stands which is measured by the wall thickness gauge and the measured value of the rolling load in each of the plurality of stands which is measured by the rolling load measuring devices, that a flaw has developed in the mother tube when the measured value of the tube wall thickness in any of the reducing directions locally varies by at least a predetermined amount and when the measured value of the rolling load in any of the stands locally varies by at least a predetermined amount.

The present invention is also a method of detecting a flaw in a mother tube characterized by measuring the tube wall thickness in each of the reducing directions of a hollow shell being rolled in a plurality of stands constituting a mandrel mill, measuring the rolling load in each of the plurality of stands, and determining that a flaw has developed in the mother tube when the measured value of the tube wall thickness measured in any of the reducing directions locally varies by at least a predetermined amount and when the measured value of the rolling load measured in any of the plurality of stands locally varies by at least a predetermined amount.

According, to the present invention, flaws such as inner surface indentation flaws, perforation flaws, and wrinkle flaws which develop in a mother tube which is manufactured by rolling a hollow shell using a mandrel mill can be automatically detected with high accuracy.

Therefore, by generating an alarm or the like when a flaw which develops in a mother tube is automatically detected by the present invention, even if a control room is disposed in a location remote from a mandrel mill, an operator can immediately stop the operation of the mandrel mill and identify the cause of occurrence of the flaw and rapidly carry out a countermeasure. Therefore, the occurrence of a large number of defective products can be prevented in advance.

In addition, according to the present invention, in a mandrel mill constituted by two-roll stands, when the measured value of the wall thickness locally varies only in one of the reducing directions, it is possible to identify the occurrence of flaws as that caused by rolling in either odd number stands or even number stands having the same reducing directions, and when only the measured value of the rolling load in any of the stands locally varies, it is possible to identify the occurrence of flaws as that caused by rolling in this stand. Therefore, a countermeasure for eliminating the flaw can be rapidly carried out.

BRIEF EXPLANATION OF THE DRAWINGS

FIG. 5(*a*) shows inner surface indentation flaws, FIG. 5(*b*) shows perforation flaws, and FIG. 5(*c*) and FIG. 5(*d*) shows a wrinkle flaw.

LIST OF SYMBOLS

Figure 1:
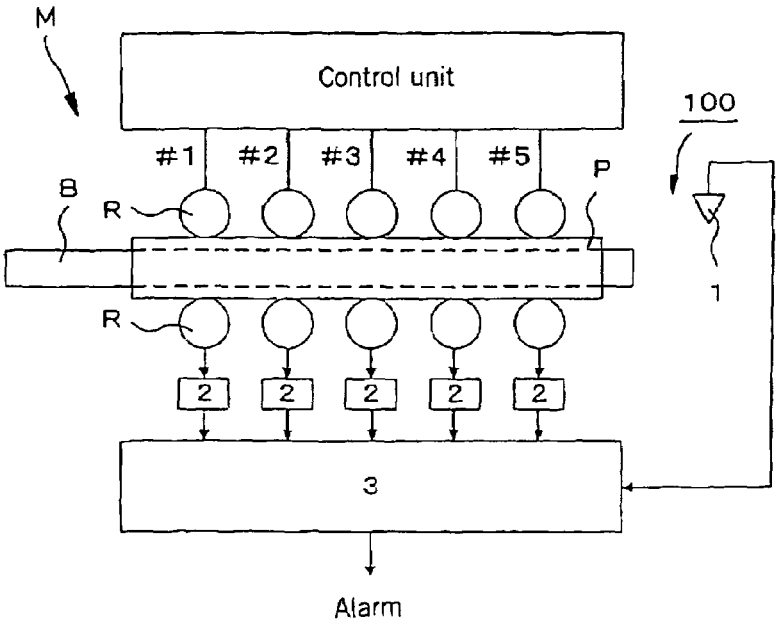
FIG. 1 is an explanatory view schematically showing the structure of a mandrel mill to which an embodiment of a flaw detection apparatus according to the present invention is applied.

1: wall thickness gauge
2: rolling load measuring device
3: decision unit
4: indentation flaw
5: hole
6: wrinkled portion
11*a*, 12*a*: γ-ray projector
11*b*, 12*b*: γ-ray receiver
100: flaw detection apparatus
M: mandrel mill
B: mandrel bar
P: hollow shell or mother tube
R: grooved roll

BEST MODE FOR CARRYING OUT THE INVENTION

The best mode for carrying out a flaw detection apparatus and method for a mother tube according to the present invention will be explained in detail while referring to the attached drawings. In the following explanation, an example will be given of the case in which a flaw detection apparatus for a mother tube according to the present invention is applied to a mandrel mill of the two-roll type.

FIG. 1 is an explanatory view showing the structure of a mandrel mill M employing a flaw detection apparatus of this embodiment.

As shown in this figure, this mandrel mill M is constituted by a total of 5 stands, i.e., #1-#5 stands. This mandrel mill M is a two-roll mandrel mill in which pairs of opposing grooved rolls R having reducing directions which differ by 90° between adjoining stands are alternatingly provided in each of the #1-#5 stands.

A hollow shell P undergoes elongation rolling using a mandrel bar B which is inserted into the interior of the hollow shell P and the grooved rolls R which are installed in each of the #1-#5 stands, whereby a mother tube is manufactured.

A flaw detection apparatus 100 according to this embodiment includes a wall thickness gauge 1 which is installed on the exit side of the mandrel mill M constituted as described above and which measures the thickness of the rolled tube (mother tube) in each of the reducing directions of the hollow shell P in the #1-#5 stands of the mandrel mill M, a plurality of rolling load measuring devices 2 which measure the rolling loads in the #1-#5 stands, and a decision unit 3 which determines whether there is a flaw in the mother tube P based on the measured value of the wall thickness of the tube in each reducing direction of the hollow shell P measured by the wall thickness gauge 1 and the measured values of the rolling loads in the 11-#5 stands measured by the rolling load measuring devices 2.

A γ-ray wall thickness gauge which measures the wall thickness based on the attenuation of γ-rays passing through the mother tube P is used as the wall thickness gauge 1 in this embodiment. This wall thickness gauge 1 is equipped with a plurality of γ-ray projectors 11*a* and 12*a* which are disposed so that the direction of irradiation of γ-rays correspond to the reducing directions of the hollow shell P in the #1-#5 stands, and a plurality of γ-ray receivers 11*b*, 12*b* which are positioned opposing each of the γ-ray projectors 11*a*, 12*a* through the mother tube P. The wall thickness gauge 1 is constituted so as to be able to continuously measure the average wall thickness of the mother tube P in each of the directions of irradiation of γ-rays along the longitudinal direction of the tube P.

Figure 2:
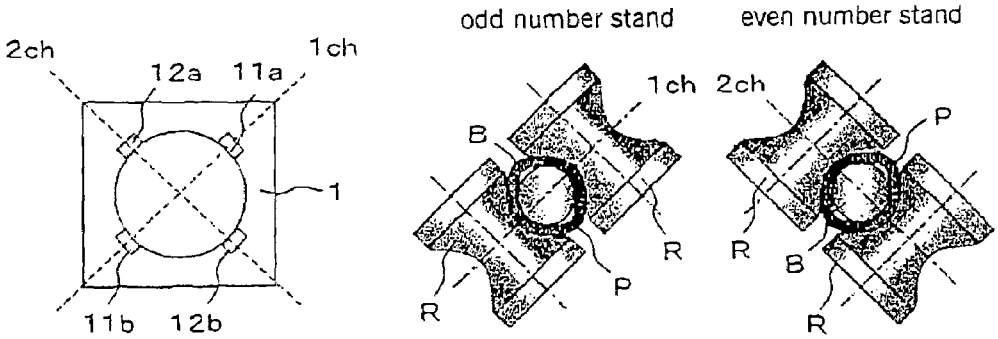
FIG. 2 is an explanatory view schematically showing the structure of the wall thickness gauge in FIG. 1.

FIG. 2 is an explanatory view schematically showing the structure of the wall thickness gauge 1 in FIG. 1.

As shown in this figure, the wall thickness gauge 1 according to this embodiment includes a γ-ray projector 11*a* having a direction of irradiation which corresponds to a reducing direction (1*ch*) of the hollow shell P in the #1, #3, and #5 stands which are the odd-numbered stands and a γ-ray receiver 11*b* disposed opposite it, and a γ-ray projector 12*a* having a direction of irradiation corresponding to a reducing direction (2*ch*) of the hollow shell P in the #2 and #4 stands which are the even-numbered stands and a γ-ray receiver 12*b* disposed opposite it. The wall thickness gauge is constituted so as to be able to continuously measure the average wall thickness of the mother tube P in each of reducing directions 1*ch* and 2*ch* along the longitudinal direction of the mother tube P.

In this embodiment, load cells are used as the rolling load measuring devices 2. They are constituted so as to be able to continuously measure the rolling load applied to the hollow shell P in each of the #1-#5 stands in the longitudinal direction of the hollow shell P. A rolling load measuring device according to the present invention is not limited to a load cell, and it may determine the rolling load, for example, by calculation based on the pressure applied by a hydraulic pressing device which adjusts the rolling position of the grooved rolls R in each stand.

The decision unit 3 receives as inputs the measured value of the wall thickness (the average wall thickness) of the rolled tube in each of the reducing directions (1*ch* and 2*ch*) of the hollow shell P measured by the wall thickness gauge 1 and the measured value of the rolling load for each of the #1-#5 stands measured by the rolling load measuring devices 2. Based on these input data, the decision unit 3 determines whether a flaw in the mother tube P has occurred. The decision unit 3 determines that a flaw has developed in the mother tube P when the measured value of the wall thickness in any of the reducing directions locally varies by at least a predetermined amount and when the measured value of the rolling load in any of the stands locally varies by at least a predetermined amount.

Figure 3:
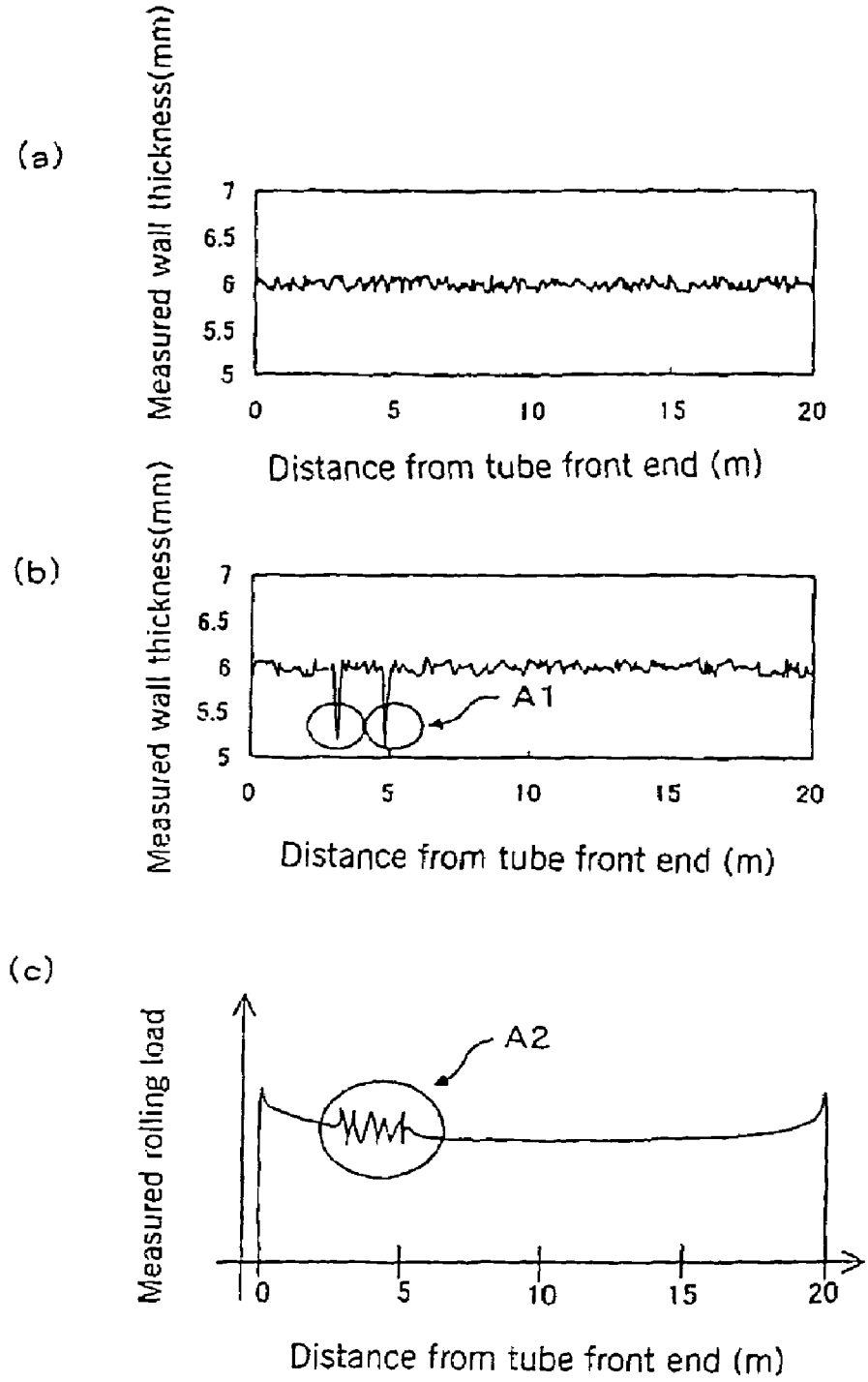
FIG. 3 gives graphs showing an example of the measured values of the wall thickness measured by the wall thickness gauge in FIG. 1 and the measured value of the rolling load measured by the rolling load measuring device in FIG. 1 for a mother tube in which a perforation flaw has developed.

FIG. 3 are graphs showing an example of the measured values of the wall thickness measured by the wall thickness gauge 1 of FIG. 1 and the measured value of the rolling load measured by a rolling load measuring device 2 of FIG. 1 for a mother tube in which a perforation flaw has developed. FIG. 3(*a*) shows the measured value of the wall thickness in reducing direction 1*ch* of FIG. 2, and FIG. 3(*b*) shows the measured value of the wall thickness in reducing direction 2*ch* in FIG. 2. FIG. 3(*c*) shows the measured value of the rolling load for the #2 stand. The distance (m) from the front end of the tube which is the horizontal axis in the graphs of FIGS. 3(*a*)-3(*c*) shows the distance from the front end of the mother tube P after rolling, and in the graph of FIG. 3(*c*), it was calculated by converting the time from when the hollow shell P is gripped by the rolls in the #2 stand until it passes the stand into the length of the mother tube P.

In the case shown in the graphs of FIG. 3, the decision unit 3 first compares the measured value of the wall thickness in each of reducing direction 1*ch* and reducing direction 2*ch* with a predetermined threshold value.

At this time, in order to eliminate gentle variations in wall thickness produced even when flaws are not occurring, the measured value of the wall thickness in each of reducing directions 1*ch* and 2*ch* may be differentiated in the longitudinal direction of the mother tube P, and the data after differentiation may be compared with a predetermined threshold value. Alternatively, the measured value of the wall thickness in each of reducing directions 1*ch* and 2*ch* for a normal mother tube P without flaws may be previously stored, and the difference between this value and the measured value of the wall thickness in each of reducing directions 1*ch* and 2*ch* which was measured may be compared with a predetermined threshold value.

When the threshold value is exceeded at locations A1 of the measured value of the wall thickness in reducing direction 2*ch* shown in the graph of FIG. 3(*b*), it is decided that the measured value of the wall thickness at locations A1 has locally varied by at least a predetermined amount.

The threshold value may be an absolute value, or it may be a ratio with respect to the wall thickness of the mother tube. For example, when manufacturing a mother tube with a wall thickness of 20 mm, it can be decided that a perforation flaw has developed if there is a portion where the wall thickness has decreased by at least 2 mm, and it can be decided that a wrinkle flaw has developed if there is a portion where the wall thickness has increased by at least 2 mm. If 20% of the wall thickness of a mother tube is made a threshold value, it can be decided that a perforation flaw has developed if there is a portion where the wall thickness has decreased by at least 4 mm, and it can be decided that a wrinkle flaw has developed if there is a portion where the wall thickness has increased by at least 4 mm.

Next, the decision unit 3 determines whether the measured value of the rolling load in each of the stands has locally varied by at least a predetermined amount. Namely, in the same manner as the above-described case concerning the measured value of the wall thickness, the measured value of the rolling load in each to stand is compared with a predetermined threshold value.

At this time, the measured values of the rolling load in the stands may be differentiated with respect to the longitudinal direction of the hollow shell P in order to eliminate gentle variations in rolling load which develop even when flaws have not occurred, and the data after differentiation treatment may be compared with a predetermined threshold value. Alternatively, the measured value of the rolling load in each stand for a normal mother tube P in which flaws have not developed may be previously stored, and the difference between this and the measured value of the rolling load measured at each stand may be compared with a predetermined threshold value.

When the threshold value is exceeded at location A2 shown in the graph of FIG. 3(*c*) which is the location of the measured value of the rolling load corresponding to #2 stand, it is decided that the measured value of the rolling load at location A2 has locally varied by at least a predetermined amount.

The threshold value of the load for use in decision is preferably a ratio. An average predicted value of the rolling load can be preliminary determined either by numerical calculation or empirically from the previous record of rolling loads, and a variation in load by at least 20%, for example, of the predicted value of the load may be made a threshold value for use in decision.

When the measured value of the wall thickness only in a certain reducing direction 2*ch* locally varies as in the example of FIG. 3, it is not always necessary to decide whether the measured values of the rolling load in all of the stands are locally varying by at least a predetermined amount, and it may be enough to decide whether the measured values of the rolling load are locally varying by at least a predetermined amount in the even-numbered stands, i.e., the #2 and the #4 stands having this reducing direction 2*ch*.

When the measured value of the wall thickness in any of the reducing directions locally varies by at least a predetermined amount (in the example shown in the graphs of FIG. 3, the measured value of the wall thickness in reducing direction 2*ch* varies by such an amount), and the measured value of the rolling load in any of the stands locally varies by at least a predetermined amount (in the example shown in the graphs of FIG. 3, the measured value of the rolling load in the #2 stand varies by such an amount), the decision unit 3 decides that a flaw has developed in the mother tube P, and it generates an alarm in a suitable manner such as by generating an alarm sound from a speaker installed in the control room or by producing flashing of a lamp installed on a control panel in the control room.

At this time, in the example shown in the graphs of FIG. 3, the cause of the occurrence of flaws is immediately identified as rolling in the #2 stand. Therefore, in order to rapidly cope with this situation, a warning is preferably issued not only with respect to the occurrence of a flaw but with respect to the stand number which was the cause of the occurrence of the flaw.

In the example shown in the graphs of FIG. 3, the measured value of the wall thickness has locally decreased, so it is still more preferable that an alarm be issued to produce notification that there is a high possibility that the flaw which was decided to have developed is a perforation flaw or an inner surface indentation flaw in order to make it possible to more rapidly and accurately take countermeasures after the alarm.

In the example shown in FIG. 3, in the case in which an alarm is generated to indicate that a perforation flaw or an inner surface indentation flaw caused by the #2 stand has developed, the operator may, for example, operate the control unit for the mandrel mill M shown in FIG. 1 for controlling the roll gap of the grooved rolls R installed in the #2 stand so as to open more. As a result, the occurrence of perforation flaws in mother tubes P to be rolled afterwards can be suppressed.

Causes of the occurrence of a perforation flaw include the tensile force acting on the tube between stands of a mandrel mill being too large and the rolling reduction in a stand being too large. In the former case, the rotational speed of the grooved rolls R may be adjusted so as to reduce the tension between stands. In the latter case, it is effective to increase the gap between the grooved rolls R of this stand. It can be determined whether the cause is the former or the latter by ascertaining the variation in load.

Figure 4:
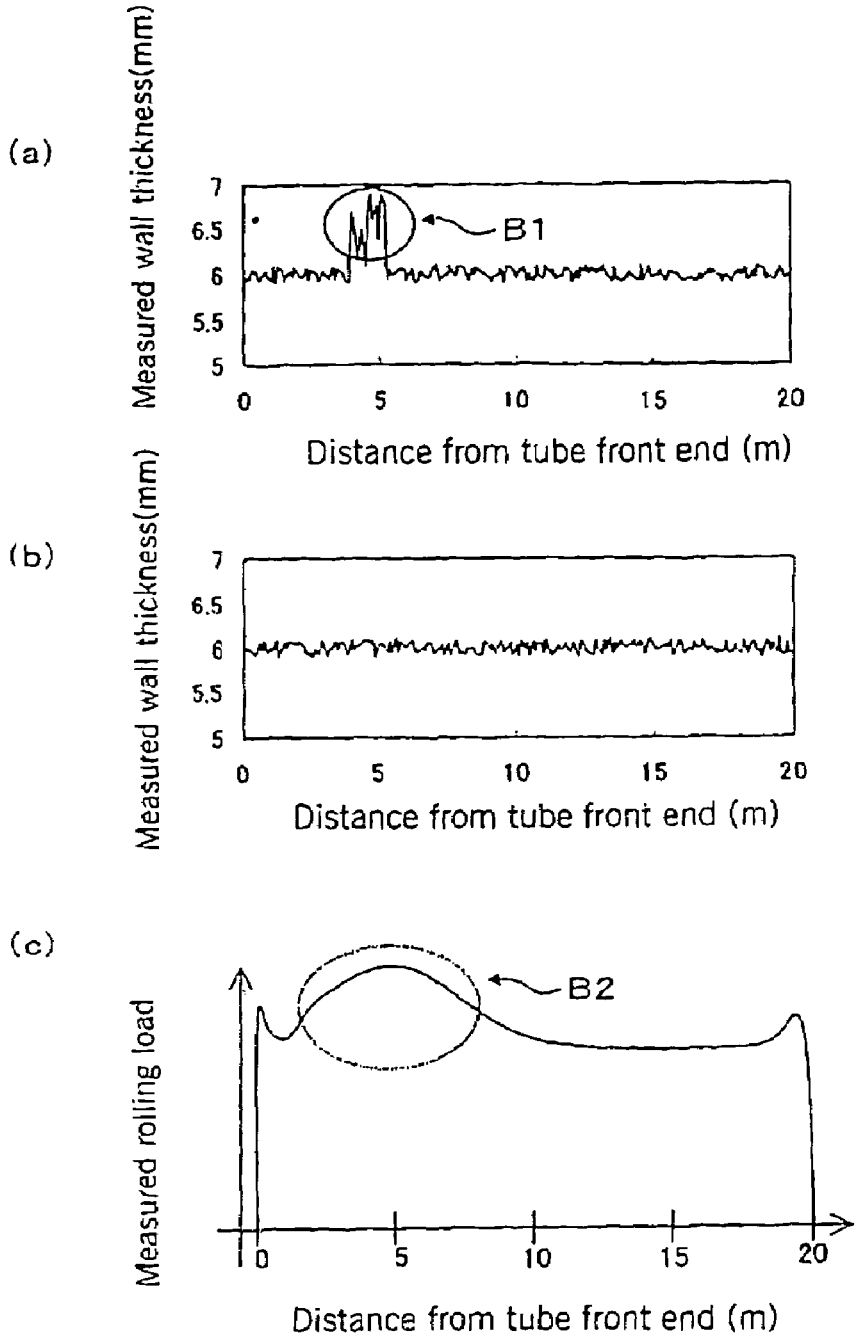
FIG. 4 gives graphs showing an example of the measured values of the wall thickness measured by the wall thickness gauge in FIG. 1 and the measured value of the rolling load measured by the rolling load measuring device in FIG. 1 for a mother tube in which a wrinkle flaw has developed.
Figure 5:
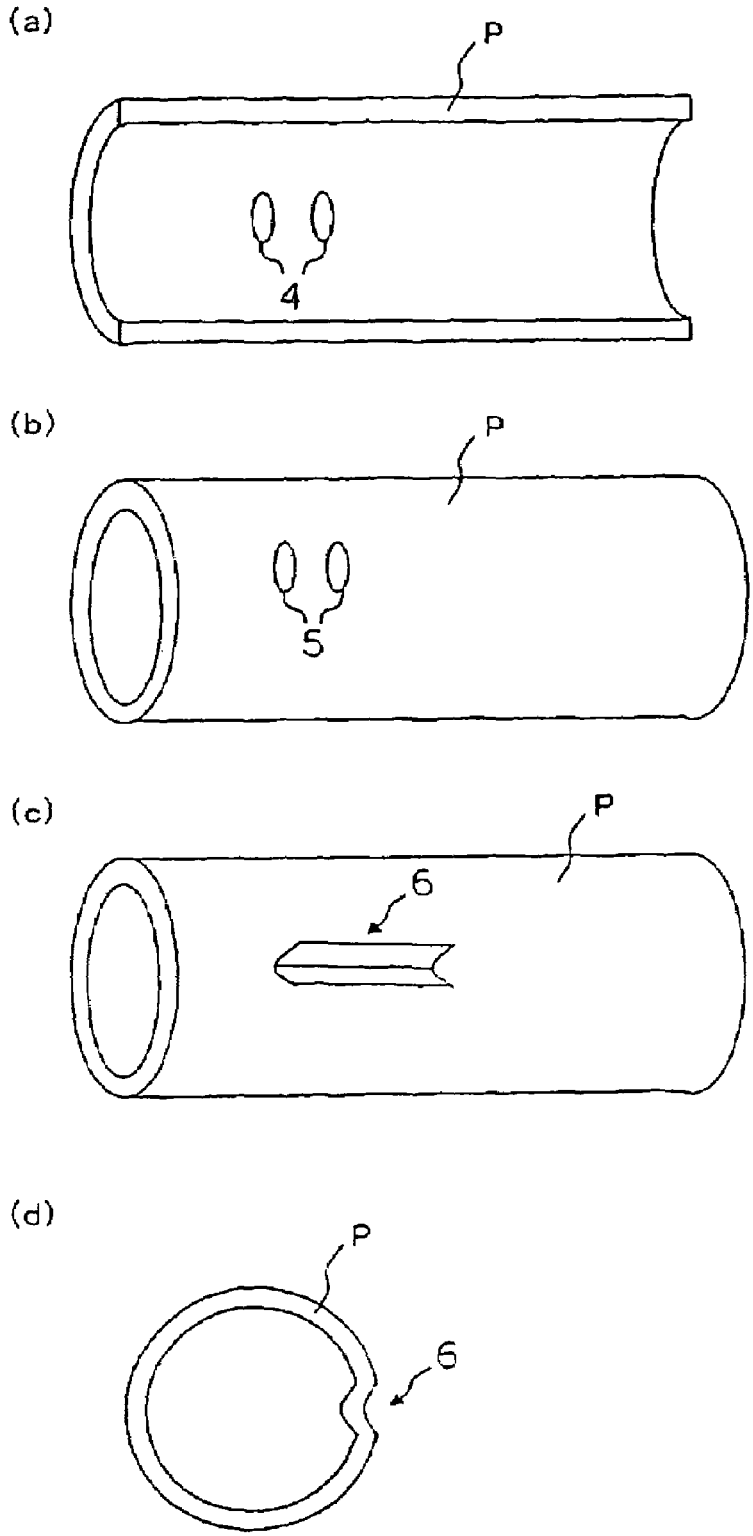
FIG. 5 gives explanatory views showing various flaws which develop in a mother tube manufactured by rolling a hollow shell using a mandrel mill.

FIG. 4 are graphs showing one example of the measured values of the wall thickness measured by the wall thickness gauge 1 in FIG. 1 and the measured value of the rolling load measured by a rolling load measuring device 2 in FIG. 1. FIG. 4(*a*) shows the measured value of the wall thickness in reducing direction 1*ch*, FIG. 4(*b*) shows the measured value of the wall thickness in reducing direction 2*ch*, and FIG. 4(*c*) shows the measured value of the rolling load for the #5 stand. The horizontal axes and the vertical axes in the graphs of FIGS. 4(*a*)-4(*c*) are the same as the horizontal axes and the vertical axes in the graphs of FIGS. 3(*a*)-3(*c*).

Also in the example shown in the graphs of FIG. 4, the decision unit 3 first compares the measured value of the wall thickness in each of reducing directions 1*ch* and 2*ch* with a corresponding predetermined threshold value. Then, when the measured value of the wall thickness in reducing direction 1*ch* shown in the graph of FIG. 4(*a*) exceeds the threshold value at location B1, it is decided that the measured value of the wall thickness is locally varying by at least a predetermined amount at location B1.

Next, the decision unit 3 determines whether the measured value of the rolling load in each stand is locally varying by at least a predetermined amount. Namely, in the same manner as for the above-described measured value of the wall thickness, the measured value of the rolling load in each stand is compared with a corresponding predetermined threshold value. When the threshold is exceeded at location B2 shown in FIG. 4(*c*) which is the location of the measured value of the so rolling load for the #5 stand, it is decided that the measured value of the rolling load at location B2 is locally varying by at least a predetermined amount.

In the example shown in the graphs of FIG. 4, when the measured value of the wall thickness only in a certain reducing direction 1*ch* is locally varying, it is not always necessary to decide whether the measured values of the rolling load in all the stands are locally varying by at least a predetermined amount, and it may be enough to decide whether the measured values of the rolling load in the odd-numbered stands, i.e., the #1, the #3, and the #5 stands having the predetermined reducing direction 1*ch* are locally varying by at least a predetermined amount.

When the measured value of the wall thickness in any reducing direction varies by at least a predetermined amount (the measured value of the wall thickness for 1*ch* varies by such an amount in the example shown in the graphs of FIG. 4) and the measured value of the rolling load in any stand locally varies by at least a predetermined amount (the measured value of the rolling load for the #5 stand varies by such an amount in the example shown in FIG. 4), the decision unit 3 decides that a flaw has developed in the mother tube P and generates an alarm.

In this case, in the example shown in the graphs of FIG. 4, it can be determined that the cause of the occurrence of the flaw is the #5 stand, so it is preferable to generate an alarm which indicates not only the occurrence of a flaw but also the stand number which is the cause of the occurrence of the flaw in order to make it possible to then rapidly carry out suitable countermeasures.

In the example shown in the graphs of FIG. 4, the measured value of the wall thickness has locally increased, so it is still more preferable to generate an alarm which also indicates that there is a high possibility that the flaw is a wrinkle flaw.

In the example shown in the graphs of FIG. 4, when an alarm is generated indicating that a wrinkle flaw caused by the #5 stand has occurred, the operator can operate the control unit for the mandrel mill M in FIG. 1 so as to decrease the rotational speed of the grooved rolls R installed in the #4 stand, thereby performing control such that the tension between the #4 stand and the #5 stand is increased. As a result, the occurrence of wrinkle flaws in mother tubes P to be rolled afterwards can be suppressed. The cause of the occurrence of wrinkle flaws is an excessive compressive force which acts on the tube between stands of the mandrel mill. Therefore, the rotational speed of the grooved rolls R can be adjusted so as to increase the tension between stands.

In this manner, according to this embodiment, flaws such as inner surface indentation flaws, perforation flaws, and wrinkle flaws which develop in a mother tube manufactured by rolling a hollow shell using a mandrel mill M can be automatically detected with high accuracy.

Therefore, by generating an alarm or the like when a flaw occurring in the mother tube is automatically detected, even in a facility layout having a control room disposed in a location remote from a mandrel mill M, the operator can immediately cease operations and identify the cause of the occurrence of flaws and rapidly take countermeasures, so the occurrence of a large number of defective products can be prevented in advance.

When only the measured value of the wall thickness in any of the reducing directions locally varies, in the case of a two-roll stand, it can be decided that a flaw is occurring due to rolling in either an odd-numbered or an even-numbered stand having this reducing direction. When only the measured value of the rolling load in any of the stands is locally varying, it can be decided that a flaw is occurring from the rolling in this stand. Therefore, a countermeasure against the occurrence of flaws can be rapidly carried out.

In the above explanation of an embodiment, an example was given of the case in which a flaw detection apparatus according to the present invention is applied to a two-roll mandrel mill. However, the present invention is not limited thereto, and it can be applied in the same manner to a four-roll mandrel mill having four grooved rolls with the reducing directions at an angle of 90° with respect to each other, or a three-roll mandrel mill having three grooved rolls installed with the reducing directions at an angle of 120° with respect to each other and with the reducing direction of the rolls differing by 60° between adjoining stands.

In the explanation of the above-described embodiment, an example was given of the case in which the control unit for the mandrel mill and the decision unit 3 in FIG. 1 are separately constituted. However, the present invention is not limited thereto, and the control unit may also perform the function of the decision unit 3. In a control unit for a typical mandrel mill, the results of measurement by a wall thickness gauge 1 installed on the exit side and the results of measurement of rolling load measuring devices 2 are often input to the control unit. Therefore, by programming a control unit which can perform the same operation as the decision unit 3, the control unit can also be used as the decision unit 3, and the cost of the overall apparatus can be decreased.

EXAMPLE 1

The present invention will be explained more specifically while referring to examples.

A flaw decision unit 100 according to the embodiment shown in FIG. 1 was applied to a two-roll mandrel mill M, and it was decided whether there was occurrence of a flaw in a mother tube by the decision unit 3. When it was decided by the unit that a flaw occurred, the roll gaps and the rotational speed of the grooved rolls R used for rolling a hollow shell P were adjusted in accordance with the result of decision.

In this example, the threshold value for the wall thickness was set to be 20% of the target wall thickness of the mother tube, and the threshold value of the rolling load was set to be 20% of the average rolling load for previously-rolled mother tubes having the same size and material.

As a result, the rate of occurrence of flaws in a mother tube (the number of mother tubes P in which a flaw occurred/number of mother tubes P being rolled ×100) could be markedly decreased to 0.03% compared to the value of 0.2% before application of the present invention for automatic sensing of flaws.

The invention claimed is:

1. A flaw detection apparatus for a mother tube which is manufactured by rolling a hollow shell in a mandrel mill having a plurality of stands, comprising a wall thickness gauge installed on the exit side of a mandrel mill for measuring the tube wall thickness of the mother tube along the longitudinal direction thereof in at least one of at least a first rolling direction and a second and different rolling direction of the hollow shell being rolled in the plurality of stands of the mandrel mill and producing a measured value corresponding to at least one of the at least first and second rolling directions, a rolling load measuring device installed in each of the plurality of stands, each rolling load measuring device producing a measured value representing a rolling load for each stand, and a decision unit which determines that a shape flaw has developed in the mother tube after rolling, based on:

(1) a determination that the measured value of the wall thickness for any of the at least first and second rolling directions varies locally by a predetermined amount with respect to a wall thickness threshold amount and;

(2) a determination that the measured value of the rolling load in any of the stands varies by a predetermined amount with respect to a rolling load threshold amount.

2. A flaw detection apparatus according to claim 1, wherein the shape flaw is one of an indentation flaw, a perforation flaw, and a wrinkle flaw.

3. A flaw detection apparatus according to claim 1, wherein the detection unit generates an alarm when the shape flaw is determined.

4. A flaw detection apparatus according to claim 1, wherein the detection unit determines that a perforation flaw has developed when the wall thickness locally decreases by at least a prescribed amount.

5. A flaw detection apparatus according to claim 1, wherein the detection unit determines that a wrinkle flaw has developed when the wall thickness locally increases by at least a prescribed amount.

6. A flaw detection apparatus according to claim 1, wherein the wall thickness gauge measures a first wall thickness in a first rolling direction corresponding to even-numbered stands of the mandrel mill and a second wall thickness in a second rolling direction corresponding to odd-numbered stands of the mandrel mill, and the decision unit determines that a flaw has occurred in one of the even-numbered stands when only the first wall thickness varies by at least the predetermined amount and determining that a flaw has occurred in one of the odd-numbered stands when only the second wall thickness varies by at least the predetermined amount.

7. A flaw detection method according to claim 1, further comprising measuring a first wall thickness in a first rolling direction corresponding to even-numbered stands of the mandrel mill and measuring a second wall thickness in a second rolling direction corresponding to odd-numbered stands of the mandrel mill, and determining that a flaw has occurred in one of the even-numbered stands when only the first wall thickness varies by at least the predetermined amount and determining that a flaw has occurred in one of the odd-numbered stands when only the second wall thickness varies by at least the predetermined amount.

8. A flaw detection method for a mother tube which is manufactured by rolling a hollow shell in a mandrel mill having a plurality of stands comprising:

measuring the wall thickness of the mother tube in at least one of at least a first rolling direction and a second and different rolling direction of a hollow shell being rolled in a plurality of stands using a wall thickness gauge installed on the exit side of the mandrel mill to produce a tube wall thickness measured value, measuring the rolling load in each of the plurality of stands to produce a rolling load measured value for each stand, and determining that a shape flaw in the mother tube has occurred when:

(1) the measured value of the tube wall thickness in any of the at least first and second rolling directions of the hollow shell in the plurality of stands locally varies in the longitudinal direction of the mother tube by at least a wall thickness predetermined amount with respect to a wall thickness threshold amount and;

(2) when the measured value of the rolling load in any of the plurality of stands varies by at least a rolling load predetermined amount with respect to a rolling load threshold amount.

9. A flaw detection method according to claim 8, further comprising generating an alarm when a flaw has occurred.

10. A flaw detection method according to claim 8, wherein the shape flaw is a surface flaw in the mother tube.

11. A flaw detection method according to claim 8, wherein the surface flaw is one of an indentation flaw, a perforation flaw, and a wrinkle flaw.

* * * * *